US011118879B2

(12) United States Patent
Fimbinger et al.

(10) Patent No.: US 11,118,879 B2
(45) Date of Patent: Sep. 14, 2021

(54) PROJECTILE FOR FIREARMS

(71) Applicant: Johann Fimbinger, Kalsdorf (AT)

(72) Inventors: Johann Fimbinger, Kalsdorf (AT); Eric Fimbinger, Lebring-Sankt Margarethen (AT)

(73) Assignee: Johann Fimbinger, Kalsdorf (AT)

( * ) Notice: Subject to any disclaimer, the term of this patent is extended or adjusted under 35 U.S.C. 154(b) by 0 days.

(21) Appl. No.: 16/869,045

(22) Filed: May 7, 2020

(65) Prior Publication Data

US 2020/0408493 A1 Dec. 31, 2020

Related U.S. Application Data

(63) Continuation of application No. PCT/EP2018/080768, filed on Nov. 9, 2018.

(30) Foreign Application Priority Data

Nov. 10, 2017 (DE) ..... 10 2017 126 442.6

(51) Int. Cl.
*F42B 10/44* (2006.01)
*F42B 5/02* (2006.01)
*F42B 10/46* (2006.01)

(52) U.S. Cl.
CPC ..... *F42B 10/44* (2013.01); *F42B 5/025* (2013.01); *F42B 10/46* (2013.01)

(58) Field of Classification Search
CPC ..... F24B 10/44; F24B 10/46
USPC ..... 102/439
See application file for complete search history.

(56) References Cited

U.S. PATENT DOCUMENTS

| | | | | |
|---|---|---|---|---|
| 4,327,643 | A | 5/1982 | Barrios | |
| 4,517,897 | A * | 5/1985 | Kneubuhl | B21K 1/025 102/439 |
| D632,357 | S * | 2/2011 | Dixon | D22/116 |
| 8,893,621 | B1 * | 11/2014 | Escobar | F42B 10/44 102/503 |
| 9,709,368 | B2 * | 7/2017 | Mahnke | F42B 30/02 |
| 9,719,762 | B2 * | 8/2017 | Langenbeck | F42B 30/02 |
| 9,857,155 | B2 * | 1/2018 | Boatright | F42B 14/02 |
| 10,222,188 | B2 | 3/2019 | Kunz et al. | |
| 10,502,536 | B2 | 12/2019 | Mahnke | |
| 10,578,410 | B2 * | 3/2020 | Mahnke | F42B 10/26 |

(Continued)

FOREIGN PATENT DOCUMENTS

WO 2015162254 A1 10/2015

OTHER PUBLICATIONS

International Search Report issued by the International Search Authority for corresponding International Patent Application No. PCT/EP2018/080768, dated Feb. 5, 2019.

(Continued)

*Primary Examiner* — Samir Abdosh
(74) *Attorney, Agent, or Firm* — Myers Wolin, LLC

(57) ABSTRACT

A projectile for firearms is provided, which is designed as a slender rotation body for ultrasonic velocity, having an approximately cylindrical center part, a tip on the front end and a tail on the rear end which tapers conically toward a projectile base, wherein the projectile is designed such that the circumferential flow remains uniform over the entire trajectory thereof from a front shock wave, through a boundary layer enclosing the projectile body to a rear tail vortex.

7 Claims, 5 Drawing Sheets

(56) References Cited

U.S. PATENT DOCUMENTS

| | | | | |
|---|---|---|---|---|
| 10,890,423 | B2 * | 1/2021 | Stadelmann | F42B 12/06 |
| 2004/0050284 | A1 * | 3/2004 | Piela | F42B 30/02<br>102/501 |
| 2012/0216700 | A1 * | 8/2012 | Dennison | F42B 10/42<br>102/514 |
| 2015/0337878 | A1 | 11/2015 | Schlosser | |
| 2016/0091288 | A1 | 3/2016 | Daniau | |
| 2017/0089677 | A1 * | 3/2017 | Boatright | F42B 30/02 |

OTHER PUBLICATIONS

Lutz Moeller, LM7 7 mm sports bullet for Windhoek, 2016, retrieved from the Internet: http://lutzmoeller.net/7-mm/LM-7.php, Mar. 22, 2018, with English translation attached.

* cited by examiner

PROJECTILE FOR FIREARMS

CROSS REFERENCE TO RELATED APPLICATIONS

This application is a continuation under 35 U.S.C. § 120 of International Application PCT/EP2018/080768, filed Nov. 9, 2018, which claims priority to German Application No. 10 2017 126 442.6, filed Nov. 10, 2017, the contents of each of which are incorporated by reference herein.

FIELD OF THE INVENTION

The invention relates to a bullet for firearms, which bullet is intended as a projectile for explosive propellant charges in cartridges for firearms, especially as a bullet for long-barrel weapons such as rifles.

BACKGROUND

Such bullets for cartridge ammunition have at the front end a tip, adjoined by an approximately cylindrical middle part, which is surrounded by the neck of a cartridge case. The tail of the bullet adjoining the middle part tapers as a conical solid of revolution toward a bullet bottom forming the end of the bullet.

The present invention relates to bullets in the form of slender solids of revolution, which are constructed in particular as bullets suitable for supersonic velocities in excess of Mach 1 and thus also satisfy the requirements of military use.

The theoretical and practical fundamentals of bullet design can be found in extensive international literature, such as cited in, for example, the bibliography of "Beat P. Kneubuehl", published in "Verlag Stocker-Schmid AG, CH-8953 Dietikon-Zürich, 2013 Edition (ISBN 978-3-7276-7176-0)". In this respect, reference is made to "Kneubuehl" concerning the scope of disclosure in the following description.

Moreover, concerning the prior art, reference is made to Lutz Möller "LM7 Geschoss [LM7 bullet]", published under http://lutzmöller.net/7-mm/LM-7.pHp. Möller performed ballistics tests on a cartridge with the parameters 4.82 g RS 60=EI Niesen 145 4,962 bar, 60 cm barrel, 1,150 m/s $v_o$ and published a ballistics table for his bullet type 7.2, 7, Lutz Möller LM 7, wherein a bullet of configuration similar to that in the preamble of the main claim was used. According to Lutz Möller's own statements, these tests yielded "unusable results" (page 6 of 10, last lines).

Starting from the fact that, as is generally known among those skilled in the art, standard projectiles having a substantially cylindrical tail are open to improvement from the aerodynamic viewpoint, and in particular suffer from deficiencies as regards range and flight stability, an object of the present invention is to improve a bullet of the type described in the introduction with respect to target-hitting accuracy at supersonic velocity for distances up to 1300 m and even greater.

SUMMARY

Accordingly, an inventive slender projectile for supersonic velocity has a shape such that the flow around the bullet remains uniform over its entire trajectory, from a front shock wave, through a boundary layer surrounding the bullet body, to a rear tail vortex, wherein the bullet shape is designed for optimization substantially according to the smallest variation of aerodynamic drag over the length of the trajectory.

On the basis of this optimization goal, the end shape of a bullet was determined by means of mathematical approximation methods as a simulation hypothesis in a first step, then after such simulation-based optimization was subjected to initial practical tests. A specific goal was firstly to achieve hit accuracies that heretofore were usually achievable for ranges shorter than 800 m for even much longer ranges. In the process, it was found that it was possible to achieve surprisingly high target-hitting accuracy up to a range of 1.5 km with supersonic velocities, thus suggesting improved stability behavior along the entire bullet trajectory together with better propellant efficiency.

To achieve the foregoing objectives, a configuration of the bullet tip is provided that substantially describes a three-dimensional ogive shape.

The bullet tip is constructed as a solid of revolution in the form of an approximately circular ogive or similar to an elliptical ogive. This may also be constructed substantially as a partly elliptical ogive.

Thus the solid of revolution selected for the bullet tip describes an ogive shape that approximates the so-called Newton tip, which is known in itself among bullet shapes, wherein this, in a preferred embodiment, closely envelops or surrounds, externally, the Newton tip familiar to the person skilled in the art (see FIG. 5 of the drawing).

The bullet tip also differs from the known Newton tip in regard to a slightly stronger tip rounding, the radius of which is between 4 and 8% of the caliber.

Furthermore, the construction of the tail part is also particularly important for the selected bullet shape, which construction has an inwardly recessed rotationally symmetric bullet bottom, which has at its center a spire, the tip of which ends approximately at the height of the rear edge of the bullet bottom or projects slightly beyond this.

This tail part ensures a tail vortex that stabilizes the trajectory and guides the flow departing from the bullet bottom gently into the flow around the bullet.

In this connection, the generating meridian of the recess of the bullet bottom also has an influence on the stability of the trajectory of the bullet. It is provided that the meridian of the bullet bottom describes, between the tip of the spire and the rear edge of the bullet bottom, a shallow curve, the radius of curvature of which decreases close to the spire on the one hand and to the rear edge on the other hand.

In a further configuration of the bullet bottom, it is provided that its maximum depth outside the spire is between 5 and 15% of the caliber. Due to this limited depth, a detrimental reduction of the bullet mass is avoided, i.e. a valuable contribution toward improvement of the flight stability is achieved.

According to the teaching of the present invention, a clear correlation exists, as shown above, between the caliber size of the bullet and the other dimensions of the bullet.

In the following, an embodiment of the inventive bullet will be explained on the basis of the drawings, wherein the emphasis is mainly placed on the one hand on the configuration of the bullet tip and on the other hand on the bullet bottom.

Both ends, i.e. tip and tail of such a long projectile, respectively considered in themselves but also independently of one another, influence the suitability of the inventive bullet within the scope of the solution of the underlying object, i.e. both the configuration of the bullet tip and the configuration of the bullet bottom determine alone and together the result of optimization according to the teaching of the design of the bullet shape proposed.

DETAILED DESCRIPTION OF THE PREFERRED EMBODIMENTS

Figure 1:
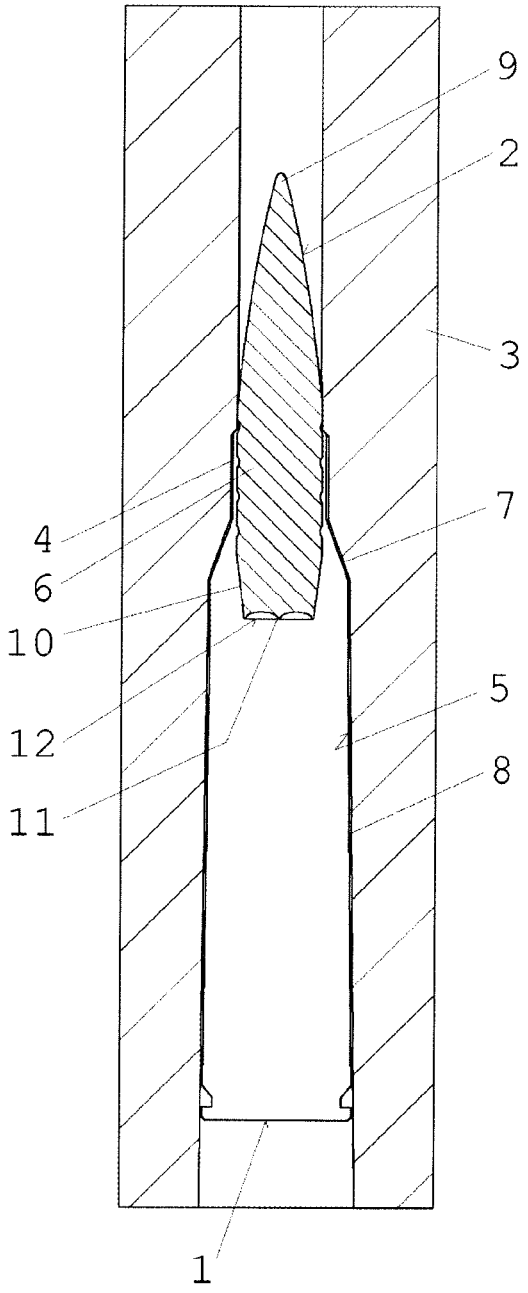
FIG. 1 shows a longitudinal section through a chamber with inserted cartridge having a bullet of caliber 0.338 (8.6 mm)

The figures of the drawing show a bullet for firearms, illustrated not to scale but namely in various magnifications, of caliber 0.338 (8.6 mm), also known by the name Lapua Magnum. It is suitable for different applications, including military use, since its target-hitting accuracy is also usable for that purpose.

According to FIG. 1, a cartridge 1 with bullet 2 and associated chamber 3 is illustrated respectively in longitudinal section. A cylindrical middle part 6 of bullet 2 is fastened in a constricted neck part 4 of a cartridge case 5, i.e. bullet 2 is seated ready for firing with central alignment in the interior of chamber 3, in which cartridge case 5 is received and axially fixed. A conical portion 7 adjoins neck part 4 of cartridge case 5 and in turn is adjoined by a cylindrical portion 8 of cartridge case 5 for accommodation of the propellant charge. The primer at the closed tail end of cartridge case 5 and the associated ignition mechanism as well as further parts of the firearm are not illustrated in FIG. 1.

Bullet 2 shown in longitudinal section has a rounded bullet tip 9 at the front end, a cylindrical middle part 6 and a tail 10, which tapers conically toward the end and ends with a bullet bottom 12 recessed around a central spire 11.

Figure 2:
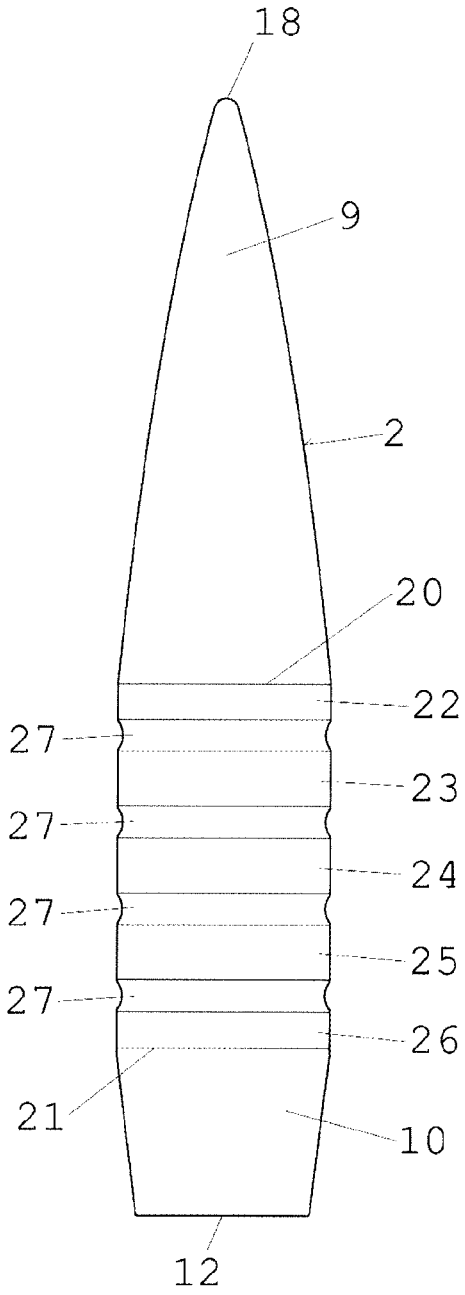
FIG. 2 shows an enlarged view of the bullet according to FIG. 1.

FIG. 2 shows an enlarged side view of bullet 2, within the cylindrical middle part 6 of which five guide bands 22 to 26 in total are provided between its upper boundary 20 and its lower boundary 21, which bands are separated from one another with four annular grooves 27 and together, as known, function to guide the bullet linearly in the barrel of the firearm. Otherwise, like reference numerals are used for like components in all figures of the drawing, and so repeated particulars and explanations in this regard are not necessary.

Figure 3:
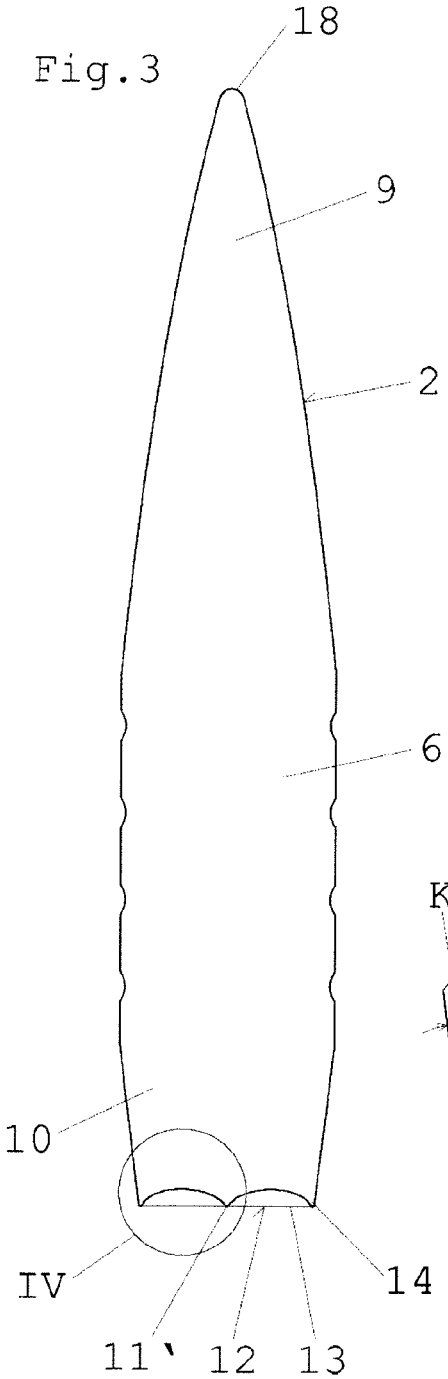
FIG. 3 shows a schematic longitudinal section through the bullet according to FIG. 2.

The recess of bullet bottom 12 is shown in a schematic bullet diagram according to FIG. 3, together with circumferential edge 13 of rear edge 14 of bullet bottom 12. Detail IV of FIG. 3 is shown in a further enlargement of the recess of bullet bottom 12 in FIG. 4. Meridian 15, which defines the shape of the rotationally symmetric recess around spire 11 of bullet bottom 12, describes a shallow curve, the radius of curvature of which decreases at both ends, on the one hand toward spire 11 and on the other hand toward rear edge 14. According to FIG. 4, tip 11' of spire 11 ends approximately at the height of rear edge 14 of bullet bottom 12.

According to FIG. 3, bullet tip 9, which is constructed as a solid of revolution, has an ogive shape, which as a solid of revolution adjoins cylindrical middle part 6 of bullet 2. The contour of this solid of revolution describes a substantially elliptical ogive, wherein its middle portion is preferably constructed as a partial portion of an ellipse. The shown ogive shape is approximately the so-called Newton tip, which is known in itself as a bullet shape, and the qualitative curve profile of which is shown by a dot-dash line 17 in FIG. 5.

Bullet tip 18 of rounded construction, wherein the radius of the tip rounding is equal to 4 to 8% of the caliber. The total tip length is equal to approximately 2.0 to 3.0 times the caliber, or approximately 40 to 60% of the bullet length. The length of the conical tail is equal to approximately 75 to 95% of the caliber. The total length of bullet 2 in turn is approximately 4.5 to 5.5 times the caliber size, and the length of cylindrical middle part 6 is approximately 1.5 to 2.0 times the caliber.

Figure 4:
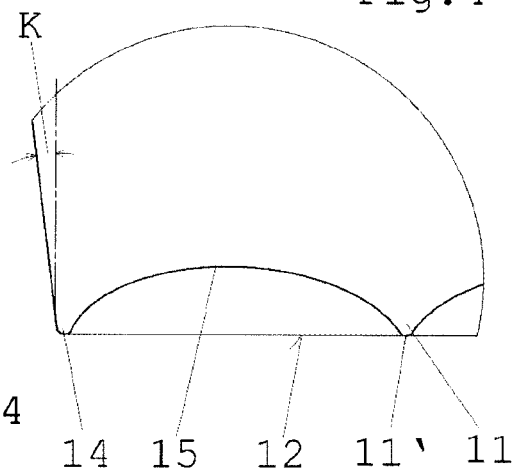
FIG. 4 shows an enlarged partial section in the region of the rear edge of the bullet bottom according to detail IV of FIG. 3.

Relative to the central axis of bullet 2, the tail cone angle K is approximately 7 degrees (see FIG. 4).

Figure 5:
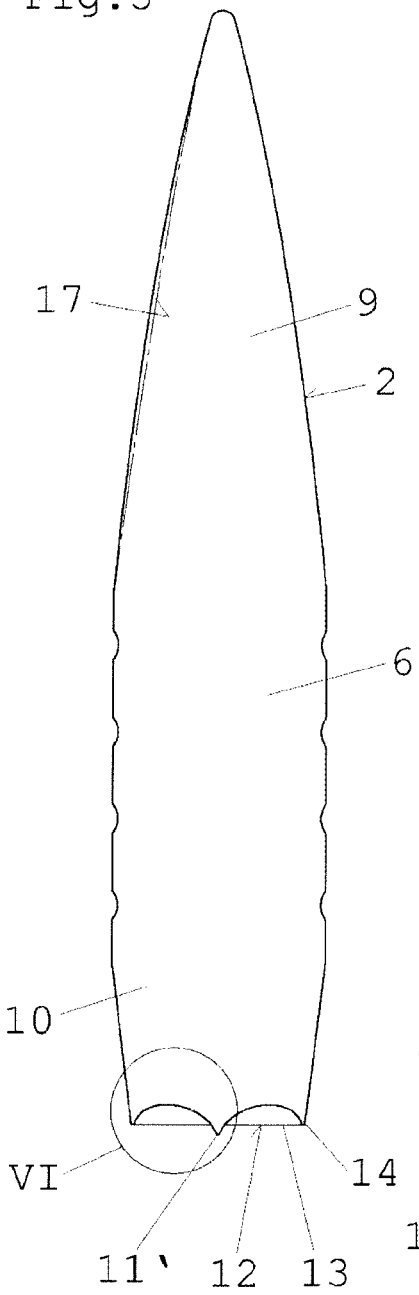
FIG. 5 shows a schematic longitudinal section through the bullet according to FIG. 3, but with alternative construction of the bullet bottom.
Figure 6:
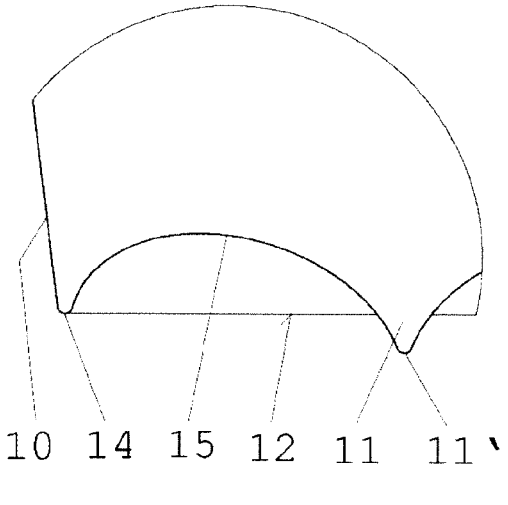
FIG. 6 shows an enlarged partial section in the region of the rear edge of the bullet bottom according to detail VI of FIG. 5.

FIGS. 5 and 6 differ from the otherwise like FIGS. 3 and 4 in terms of the construction of bullet bottom 12. In the variants according to FIGS. 5 and 6, tip 11" of spire 11 extends beyond rear edge 14 of bullet bottom 12, wherein this may be achieved by variation of the spire length or of the depth of the recess of bullet bottom 12.

Figure 7:
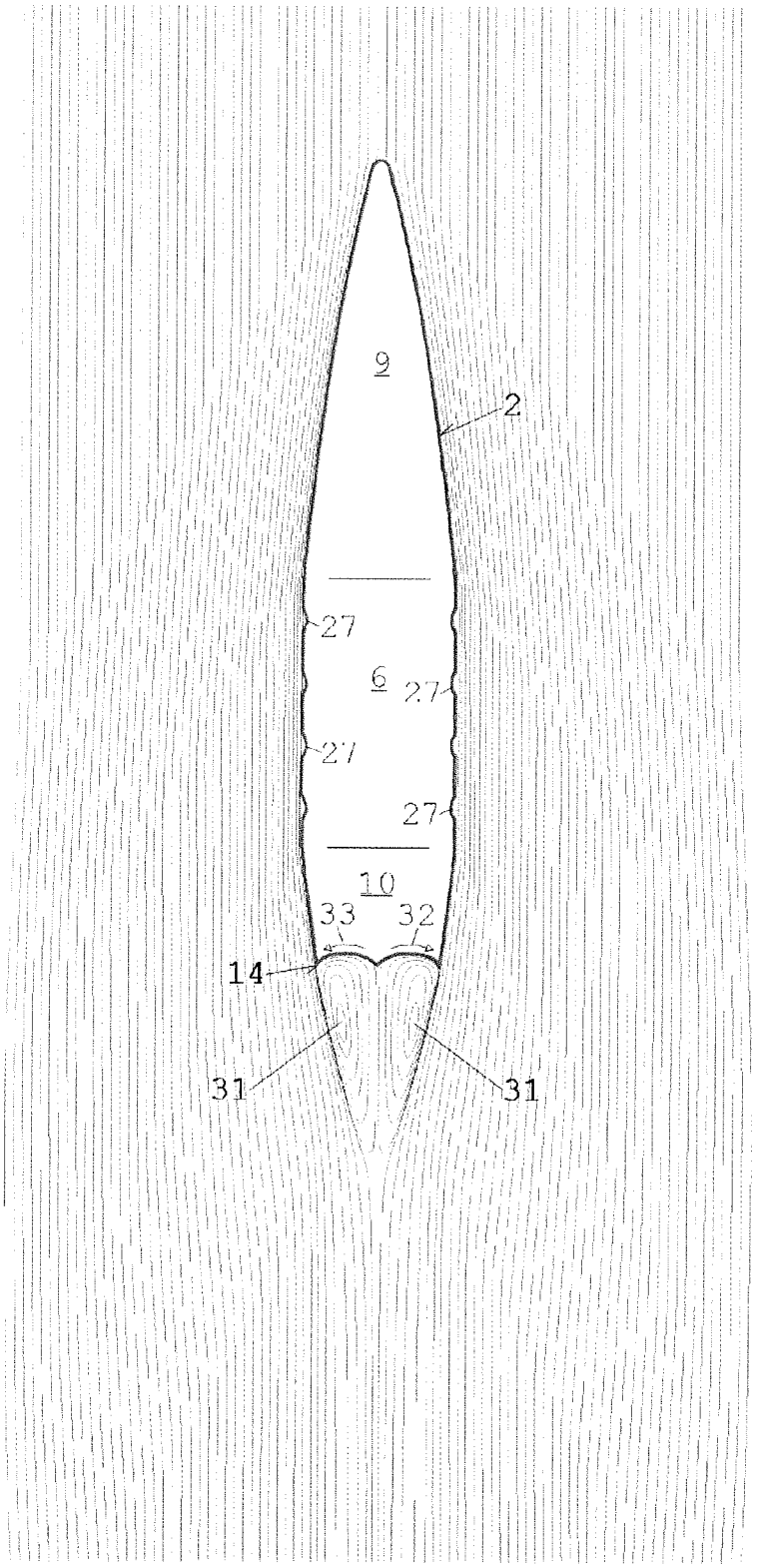
FIG. 7 shows a schematic longitudinal section through the bullet according to FIG. 3 with flow (at Mach 2) around the bullet and tail vortex.

FIG. 7 shows the flow around bullet 2, which is traveling approximately at Mach 2 and is illustrated in longitudinal section through its middle plane with streamlines corresponding to incident flow against tip 9 toward tail 10. The streamlines resemble the droplet model known from fluid mechanics and, in the region adjoining tail 10 of bullet 2, form a stable tail vortex 31, which is favored by the recessed shape of bullet bottom 12 and which forms a gentle confluence with the tail-end departing flow at bullet 2. In the transition region around rear edge 14 of bullet bottom 12, this is confirmed clearly by the steady profile of the streamlines and impressively by the droplet shape of the antiparallel vortex flow indicated by arrows 32, 33.

What is claimed is:

1. A bullet (2) for firearms, which is configured as a slender solid of revolution for supersonic velocities comprising an approximately cylindrical middle part (6) that can be embraced by the neck (4) of a cartridge case (1), at its front end a tip (9) that describes substantially a three-dimensional ogive shape and, at its rear end, a tail (10) that tapers conically toward a bullet bottom (12), wherein the bullet has an inwardly recessed rotationally symmetric bullet bottom (12), which has at its center a spire (11) the tip (11', 11") of which extends at least to the rear edge (14) of the bullet bottom (12).

2. The bullet of claim 1, wherein the bullet tip (9) describes a solid of revolution with approximately circular ogive.

3. The bullet of claim 1, wherein the bullet tip (9) is constructed as a solid of revolution similar to an elliptical ogive.

4. The bullet of claim 1, wherein the bullet tip, as a solid of revolution, describes an ogive shape approximating the so-called Newton tip.

5. The bullet of claim 1, with caliber 0.338 (8.6 mm), wherein the radius of its tip rounding (18) is between 4 and 8% of the caliber.

6. The bullet of claim 1, wherein a generating meridian (15) of the recess of the bullet bottom (12) describes, between the tip (11', 11") of the spire (11) and the rear edge (14) of the bullet bottom, a shallow curve, the radius of curvature of which decreases close to the spire (11) on the one hand and to the rear edge (14) on the other hand.

7. The bullet of claim 6, wherein the maximum depth of the bullet body outside the spire (11) is between 5 and 15% of the caliber.

* * * * *